US007537495B2

(12) United States Patent
Skrzyniarz et al.

(10) Patent No.: US 7,537,495 B2
(45) Date of Patent: May 26, 2009

(54) AUXILIARY POWER COUPLER

(75) Inventors: Jeffrey Skrzyniarz, Fraser, MI (US); Lawrence Mistalski, Clinton Township, MI (US); Tina McCleskey, Eastpointe, MI (US)

(73) Assignee: Chrysler LLC, Auburn Hills, MI (US)

( * ) Notice: Subject to any disclaimer, the term of this patent is extended or adjusted under 35 U.S.C. 154(b) by 30 days.

(21) Appl. No.: 11/865,155

(22) Filed: Oct. 1, 2007

(65) Prior Publication Data

US 2009/0088033 A1 Apr. 2, 2009

(51) Int. Cl.
*H01R 4/48* (2006.01)

(52) U.S. Cl. ..... 439/816

(58) Field of Classification Search ..... 439/816, 439/435, 757, 759, 819, 755
See application file for complete search history.

(56) References Cited

U.S. PATENT DOCUMENTS 4,342,497 A * 8/1982 Morrison ..... 439/522
4,470,654 A * 9/1984 Friedman ..... 439/435
4,948,383 A 8/1990 Tompkins
4,975,089 A * 12/1990 Lee ..... 439/755
5,861,223 A * 1/1999 Motlagh ..... 429/121
6,174,207 B1 * 1/2001 Cleveland ..... 439/773
6,783,404 B1 * 8/2004 Shammout ..... 439/759

* cited by examiner

*Primary Examiner*—Jean F Duverne
(74) *Attorney, Agent, or Firm*—Ralph E. Smith

(57) ABSTRACT

A coupler for connection of a power source to a vehicle electrical system. The coupler includes a housing arranged to be grasped by an operator, and an actuator arranged to be accessible when the housing is grasped. A plurality of electrically-conductive clasps are arranged on the housing and employ a mechanism to bias the clasps in a closed position for attachment to the vehicle electrical system. A linkage connecting the actuator to the claps is further provided to simultaneously open the clasps when the actuator is activated.

9 Claims, 5 Drawing Sheets

AUXILIARY POWER COUPLER

FIELD OF THE INVENTION

The present invention relates to a coupler for connecting a remote auxiliary power source to a vehicle electrical system.

BACKGROUND OF THE INVENTION

A vehicle's electrical system is designed to be powered by an on-board battery. However, there are situations when power for a vehicle electrical system must be provided from some external source other than the vehicle's battery. For example, during initial vehicle build in an assembly-plant, as the vehicle progresses through various assembly-line stages when the battery is disconnected from its electrical system for safety considerations, an external power source is required to systematically power-up a specific vehicle system to complete its construction. Additionally, after a vehicle leaves the assembly-line its battery may lose charge, and a jump start may be required from an auxiliary power source, e.g. from another vehicle.

Connecting means or devices typically used for this purpose are jumper cables of the type which have separate clamp or clip-type connectors for attaching the ends of a cable to terminals of the vehicle's electrical system or directly to its battery. Usually these connectors are alligator-type clamps, operation of which requires them to be individually squeezed to open and then released to close for either attachment to or detachment from the electrical system terminals. Operation of typical jumper cables is therefore either a two-handed, or a two-step affair that requires a certain minimum time and concentration to complete.

In view of the above it becomes apparent that elimination of auxiliary power supply attachment steps which are cumbersome and/or time-consuming would be desirable, particularly in a vehicle assembly-plant environment.

SUMMARY OF THE INVENTION

In accordance with one aspect of the present invention, a power coupler is provided for engagement with a vehicle's electrical system, and includes a housing to be grasped by its operator. An actuator is arranged on the housing to be accessible when the coupler is so grasped. A plurality of electrically-conductive clasps which employ a mechanism to bias the clasps in a closed position for attachment to the vehicle electrical system are arranged on the housing. A linkage connects the actuator to the clasps, and is arranged to simultaneously open the clasps when the actuator is activated.

In accordance with another aspect of the present invention, the foregoing clasps may be spaced on the housing to engage electrical system terminals so as to facilitate a one-handed engagement of the coupler with the vehicle electrical system. In accordance with yet another aspect of the present invention the coupler may further have a plurality of electrical cables attached to the clasps for connection to an auxiliary power source which may be detachable at the clasps via a quick-connect. Furthermore, the foregoing housing may be arranged as a handle, and the foregoing actuator may be positioned in that handle.

It should be understood that the detailed description and specific examples which follow, while indicating preferred embodiments of the invention, are intended for purposes of illustration only and are not intended to limit the scope of the invention.

DETAILED DESCRIPTION

In general the present invention is directed to a power coupler for connecting a remote auxiliary power source to a vehicle electrical system. More specifically, the present invention is a power coupler which is particularly well-suited for use on a vehicle assembly-line to connect a remote auxiliary power source to vehicle electrical terminals to power up a specific vehicle system to complete its construction. The present invention, however, may also be applied to power-up a vehicle electrical system from an auxiliary power source, e.g. another vehicle, in the event that the subject vehicle's battery loses charge after leaving the assembly-line.

Figure 1:
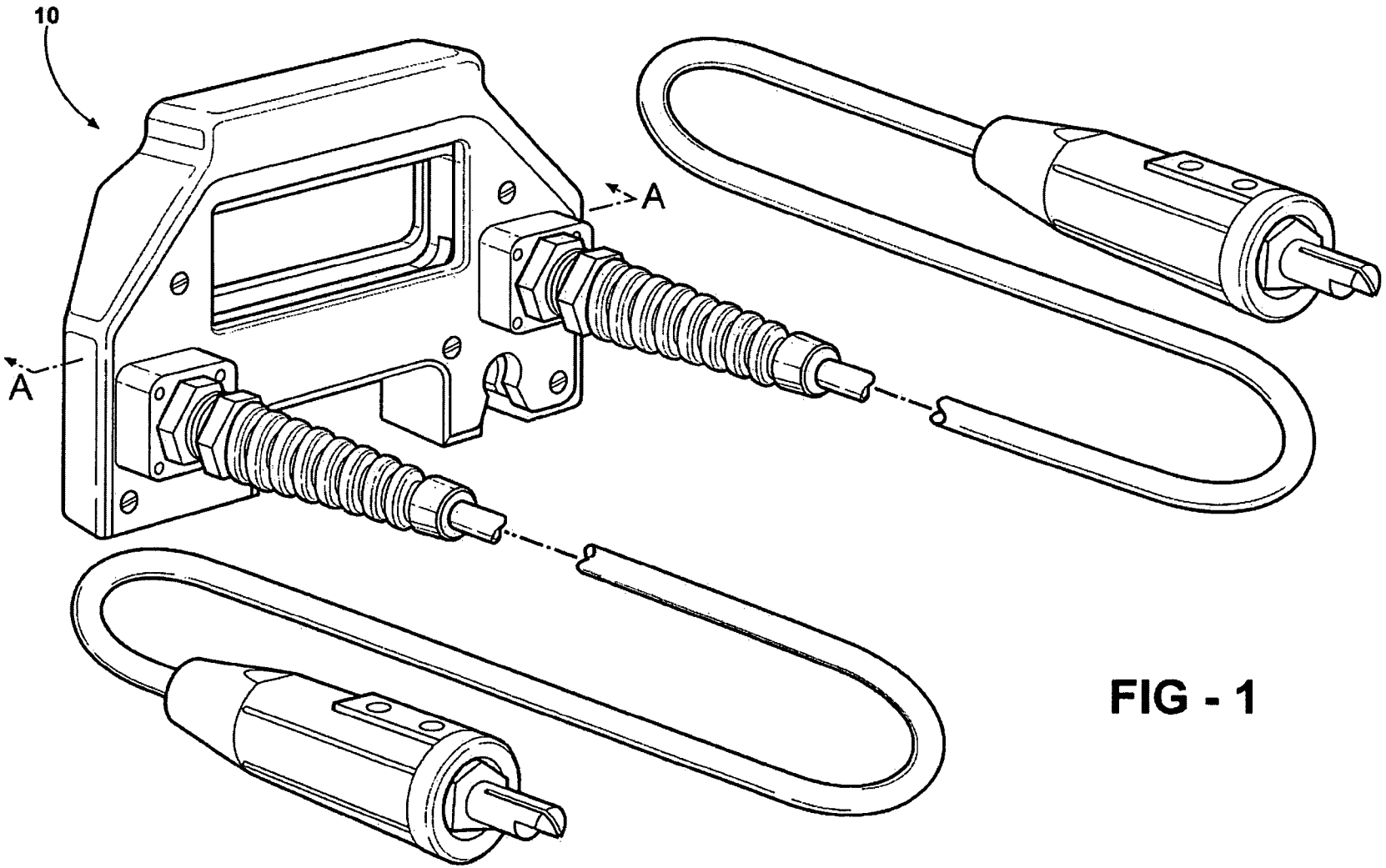
FIG. 1 is an isometric perspective view of a power coupler according to the invention.
Figure 2:
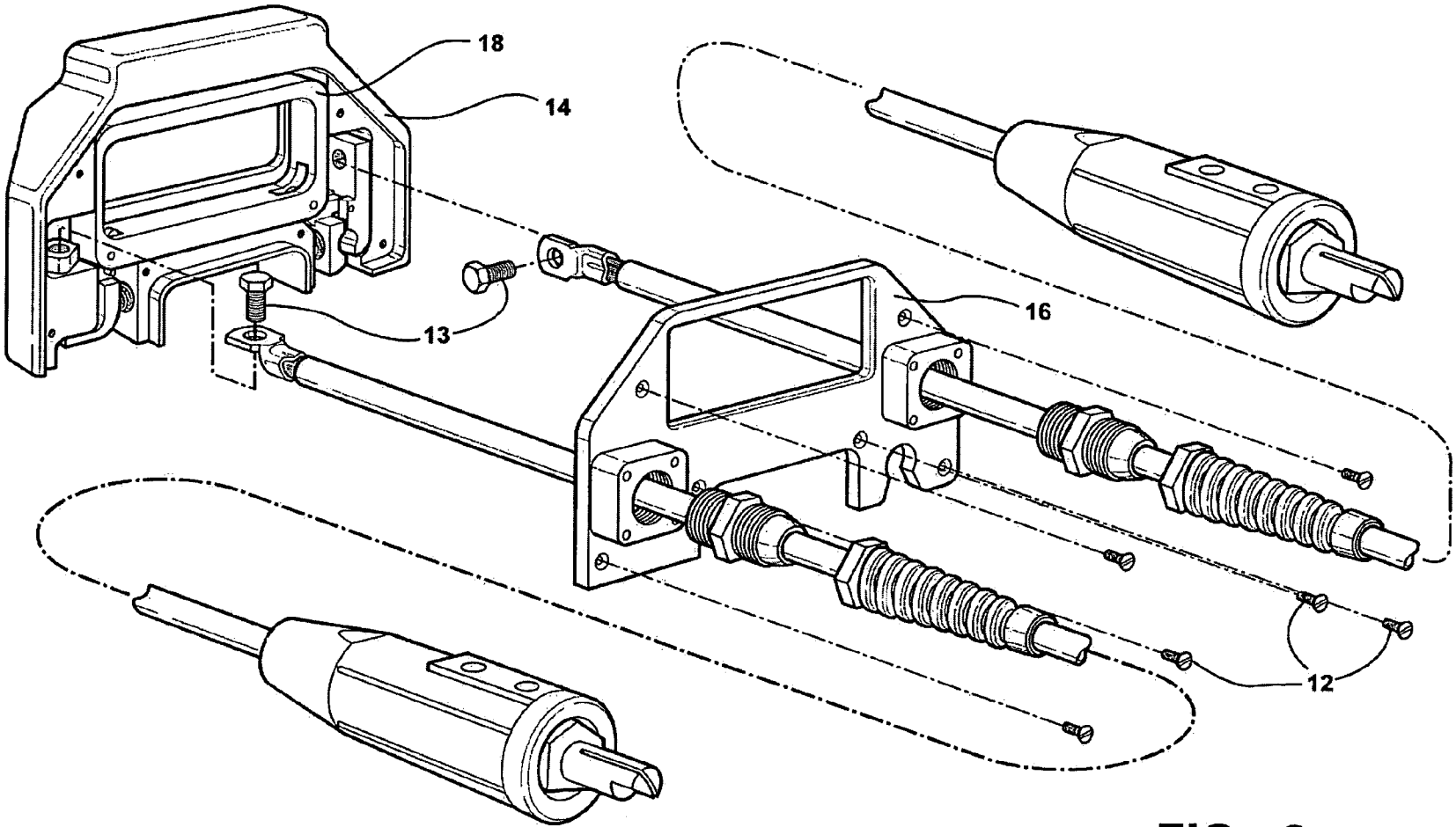
FIG. 2 is an exploded isometric perspective view of the coupler according to the invention.

Referring now to the drawings in which like elements of the invention are identified with identical reference numerals throughout, FIG. 1 denotes a coupler 10. As best seen from FIG. 2, coupler 10 is held together by screw 12, however any suitable fastener may be used. Coupler 10 includes a housing 14, a cover 16, and an actuator 18, all made from a molded engineering plastic, or any other suitable dielectric material.

Figure 3:
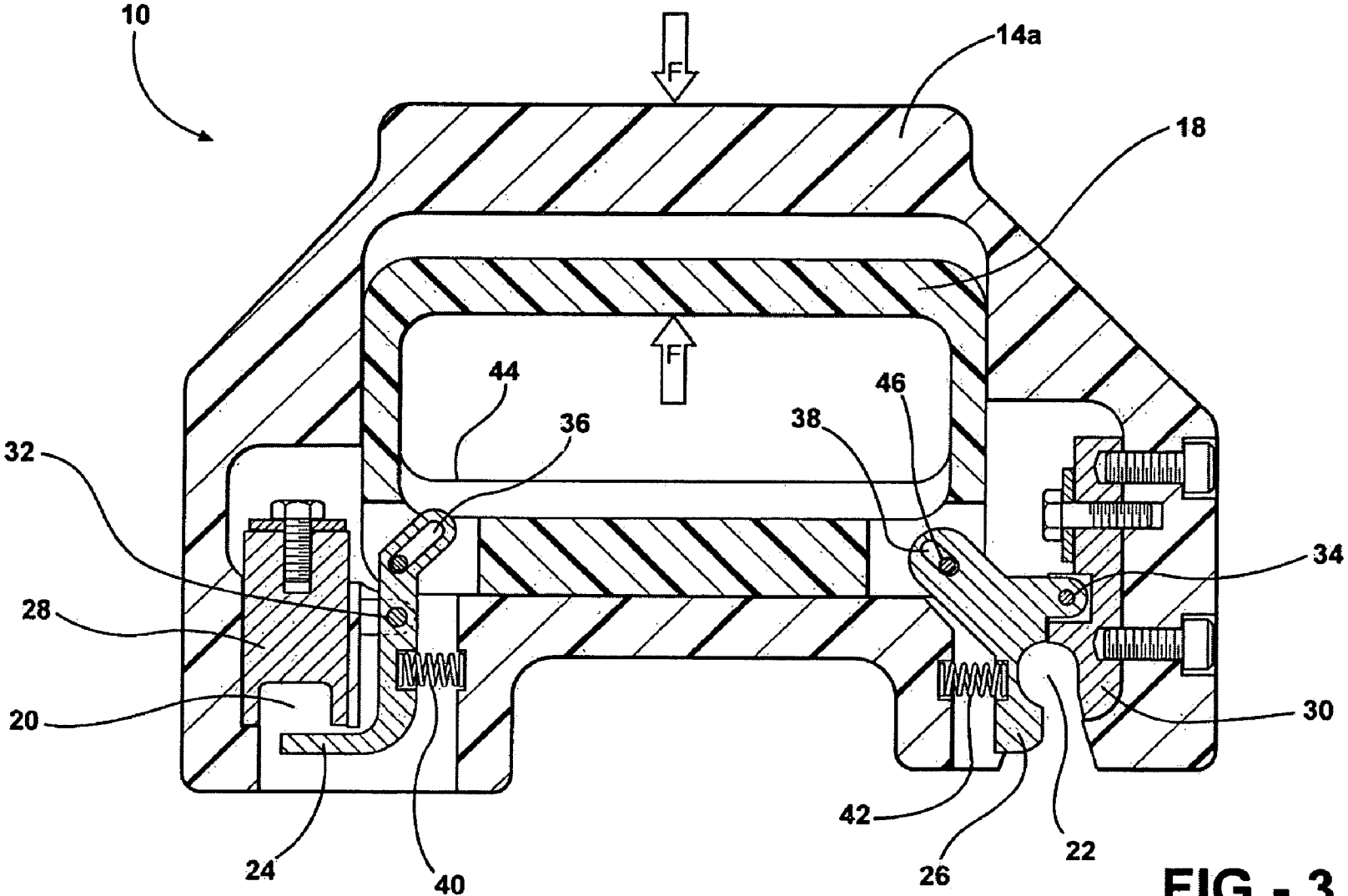
FIG. 3 is a cross-sectional view taken along line A-A of FIG. 1.

FIG. 3 denotes a cross-sectional view of coupler 10. Housing 14 has a handle-shaped upper portion 14A formed to be conveniently grasped by an operator of coupler 10. Actuator 18 is slidably positioned inside a channel which is formed by joining housing 14 and cover 16. Actuator 18 is positioned on housing 14 to be accessible by the operator's hand with which the housing is grasped. Actuator 18 is activated by the operator's hand applying a squeezing force "F", thereby sliding the actuator toward handle-shaped upper portion 14*a* of the housing, wherein, selective attachment of the coupler to vehicle electrical system terminals can be accomplished.

As seen from FIG. 3, a pair of electrically-conductive clasps 20 and 22 are arranged on the housing for attachment to a vehicle electrical system (not shown). Clasps 20 and 22 have respective pivotably moveable components 24 and 26, and stationary components 28 and 30. Pins 32 and 34, made from steel or any other suitable material, are rigidly mounted on stationary components 28 and 30 and function as pivot axes for moveable components 24 and 26. Clasps 20 and 22 are spaced on housing 14 to engage respective vehicle electrical terminals, whereby one-handed engagement of coupler 10 with the vehicle electrical system is affected. Respective coil springs 40 and 42 bias clasps 20 and 22 to a closed position, thereby facilitating attachment of the clasps to terminals of the vehicle electrical system (not shown), which may be positioned remote to or directly on the vehicle's battery. Linkage pins 44 and 46, made from steel or any other suitable material, are rigidly mounted on actuator 18. When actuator 18 is activated, linkage pins 44 and 46 simultaneously open clasps 20 and 22 by engaging and pivoting moveable components 24 and 26 via slotted openings 36 and 38.

Figure 4:
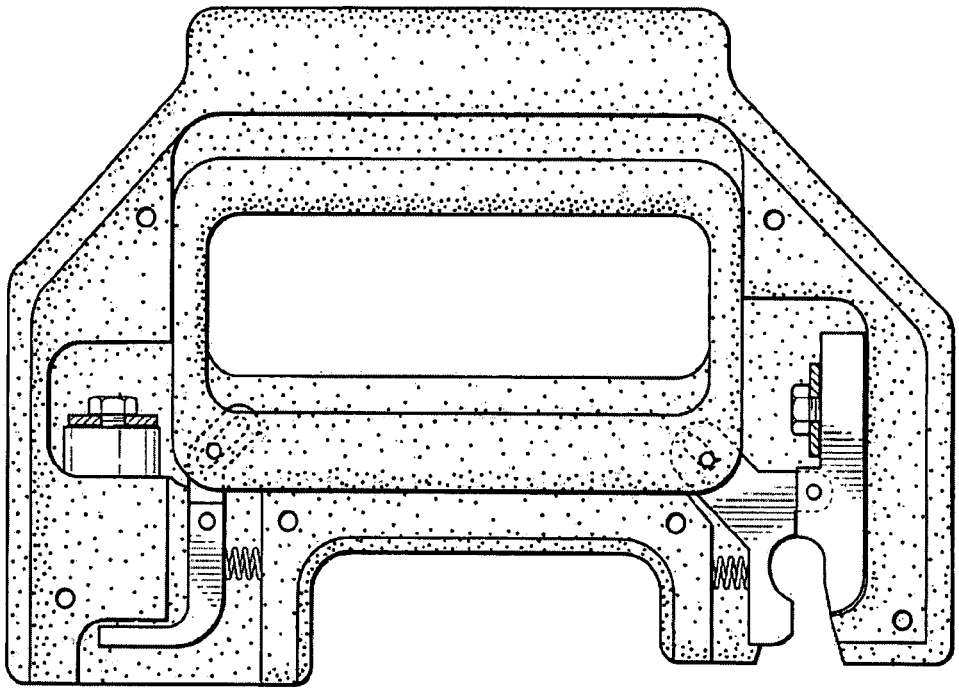
FIG. 4 is a cover-off front view of the invention with clasps closed.
Figure 5:
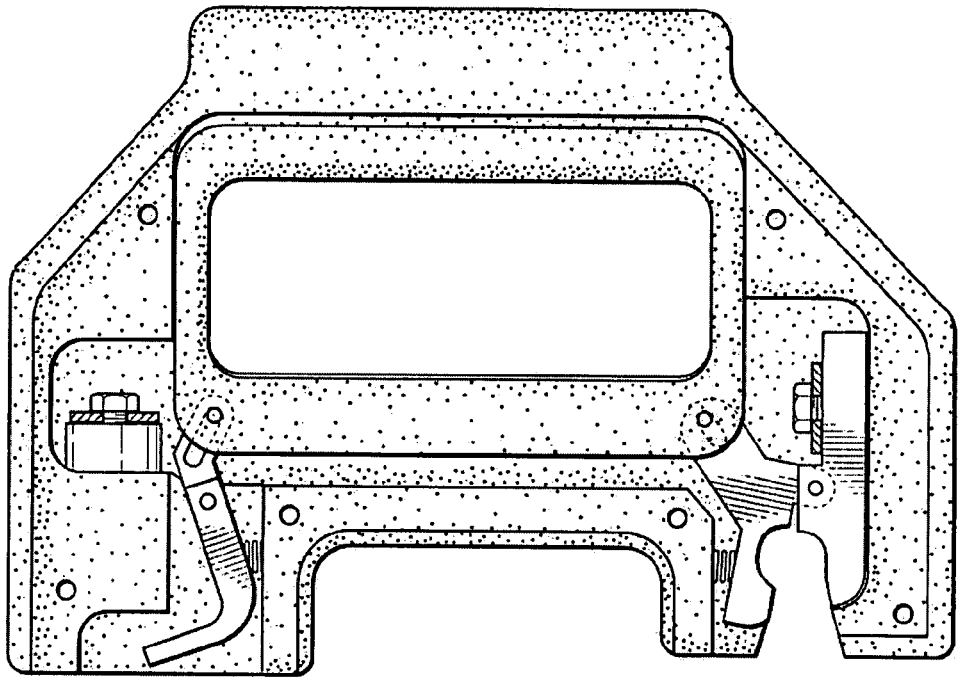
FIG. 5 is a cover-off front view of the invention with clasps open.

FIGS 4 and 5 denote cover-off views of coupler 10 showing clasps 20 and 22 in open and closed positions, respectively.

Figure 6:
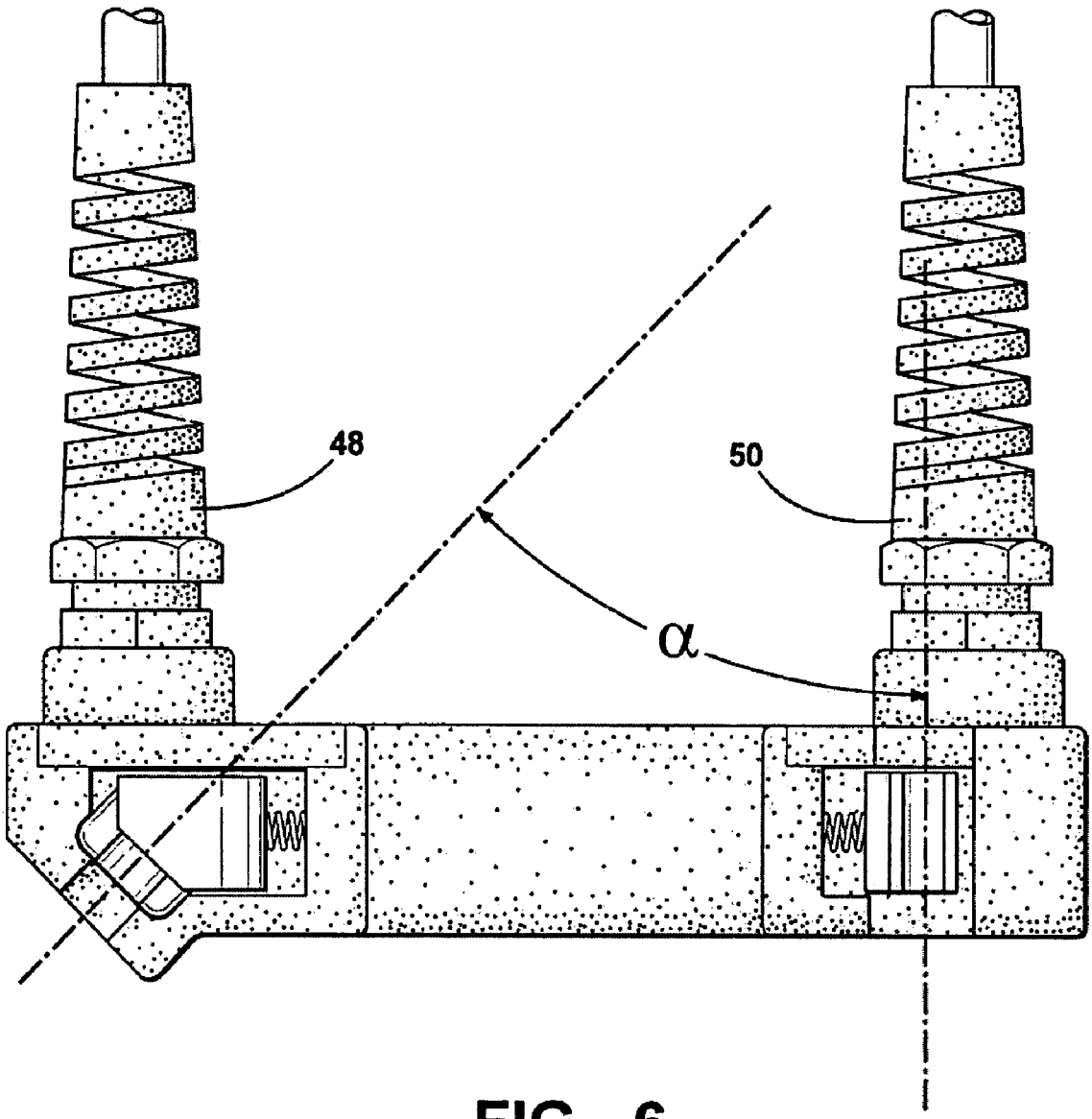
FIG. 6 is a bottom view of the invention.

FIG. 6 shows a bottom view of coupler 10 according to the present invention, whereby the coupler additionally includes two electrical cables 48 and 50, attached to clasps 20 and 22 with fasteners 13 (shown in FIG. 2) for connecting the coupler to an auxiliary power source. Electrical cables 48 and 50 can be arranged with electrical connectors (not shown) allowing quick detachment from clasps 20 and 22. As is shown in FIG. 6, clasps 20 and 22 may be arranged on housing 14 at angle "α" to each other, which corresponds to an arrangement of the vehicle electrical system terminals, and thereby facilitating a single particular way of coupler attachment to the vehicle electrical system.

Based on the foregoing, an operator may therefore grasp the coupler with one hand and activate the actuator by squeezing it toward the handle, thereby simultaneously opening both clasps, and permitting the coupler to be attached quickly and securely to vehicle electrical system terminals. Coupler attachment may be accomplished by attaching both clasps to the corresponding electrical system terminals simultaneously, or may be done sequentially, by initially attaching one clasp to the first terminal and subsequently the other clasp to the second terminal. Coupler's respective cables may be attached to an auxiliary power source to complete the electrical connection either prior to or after attachment of the coupler to the vehicle's electrical system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A coupler for the connection of a power source to a vehicle electrical system, comprising:

a housing arranged to be grasped by an operator;

an actuator arranged to be accessible when the housing is grasped;

a plurality of electrically-conductive clasps arranged on the housing employing a mechanism to bias the clasps in a closed position to facilitate attachment to the vehicle electrical system, wherein the vehicle electrical system comprises positive and negative battery terminals, and the plurality of clasps are spaced on the housing to engage respective positive and negative terminals so as to facilitate one-handed engagement of the coupler with the vehicle electrical system; and a linkage connecting the actuator to the clasps arranged to simultaneously open the clasps when the actuator is activated.

2. The coupler of claim 1 wherein the vehicle electrical system terminals are positioned remotely from the battery.

3. The coupler of claim 1 wherein the clasps are arranged on the housing to facilitate a single particular way of connecting the coupler to the vehicle electrical system.

4. The coupler of claim 1 further comprising a plurality of electrical cables attached to the clasps for connection to the power source.

5. The coupler of claim 4 wherein the plurality of electrical cables are detachable from the clasps.

6. The coupler of claim 5 wherein the plurality of electrical cables are detachable with a quick-connect mounted externally at the housing.

7. The coupler of claim 1 wherein the housing comprises a handle.

8. The coupler of claim 7 wherein the actuator is positioned in the handle.

9. A coupler for releasably connecting a vehicle electrical system to a remote power source comprising:

a housing having a handle for grasping by an operator using one hand;

at least two electrical conductors mounted within a recess on the hosing in opposed relation to said operator when grasping the handle and positioned to engage corresponding terminals on the vehicle, said conductors being arranged for pivotal movement within the recess from a closed position when at rest to an open position in operation;

an actuator mounted within the handle and arranged for sliding movement there within from a resting position to an operating position in response to an operator grasping and releasing the handle;

a linkage corresponding to each conductor having one end attached to the actuator and the other end attached to its respective connector whereby sliding movement of the actuator from a resting position to an operating position in response to the handle being grasped by an operator will pivotably move the conductors from a closed position to an open position for connecting to terminals on the vehicle when the operator's grasp on the handle is released; and a conductive cable attached to each electrical conductor and said housing, arranged to communicate with corresponding terminals on the remote power source.

* * * * *